US010335696B2

(12) United States Patent
McVeen et al.

(10) Patent No.: US 10,335,696 B2
(45) Date of Patent: Jul. 2, 2019

(54) DRIFT RACER

(71) Applicant: Universal City Studios LLC, Universal City, CA (US)

(72) Inventors: Keith Michael McVeen, Orlando, FL (US); Eric A. Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 297 days.

(21) Appl. No.: 15/152,419

(22) Filed: May 11, 2016

(65) Prior Publication Data

US 2016/0332084 A1 Nov. 17, 2016

Related U.S. Application Data

(60) Provisional application No. 62/160,400, filed on May 12, 2015.

(51) Int. Cl.

| | |
|---|---|
| ***A63G 33/00*** | (2006.01) |
| ***B61C 3/00*** | (2006.01) |
| ***B61B 13/00*** | (2006.01) |
| ***A63G 25/00*** | (2006.01) |

(52) U.S. Cl.

CPC ..... *A63G 33/00* (2013.01); *A63G 25/00* (2013.01); *B61B 13/00* (2013.01); *B61C 3/00* (2013.01)

(58) Field of Classification Search

CPC ..... A63G 25/00; A63G 31/00; A63G 31/02; A63G 31/16; A63G 33/00; A63H 18/00; B61B 5/00; B61B 5/025; B61B 13/00

See application file for complete search history.

(56) References Cited

U.S. PATENT DOCUMENTS

| | | | | |
|---|---|---|---|---|
| 2,196,093 | A * | 4/1940 | Bartlett | A63G 7/00 104/295 |
| 3,410,223 | A | 11/1968 | Miller | |
| 3,601,400 | A | 8/1971 | Boles | |
| 5,595,121 | A | 1/1997 | Elliott et al. | |
| 5,623,878 | A * | 4/1997 | Baxter | A63G 1/30 104/154 |
| 8,065,963 | B2 | 11/2011 | Groels | |
| 2009/0266266 | A1 | 10/2009 | Kilbert et al. | |

FOREIGN PATENT DOCUMENTS

| | | |
|---|---|---|
| CN | 203090451 | 7/2013 |
| WO | 9505222 A1 | 2/1995 |

OTHER PUBLICATIONS

International Search Report and Written Opinion for PCT Application No. PCT/US2016/032060 dated Sep. 21, 2016.
CN 201680027289.3 Office Action dated Mar. 29, 2019.

* cited by examiner

*Primary Examiner* — Robert J McCarry, Jr.
(74) *Attorney, Agent, or Firm* — Fletcher Yoder, P.C.

(57) ABSTRACT

A ride assembly includes a passenger vehicle having front wheels, rear wheels, a motor, and a steering wheel, where the front and rear wheels are disposed on a surface, the motor is configured to provide power to the front wheels to propel the passenger vehicle, and the steering wheel is configured to adjust a position of the rear wheels and enable the passenger vehicle to drift, a track forming a trough in the surface, and a bogie hingedly coupled to the passenger vehicle, where the bogie is disposed in the trough, and where the bogie is configured to direct movement of the passenger vehicle along the track.

20 Claims, 9 Drawing Sheets

DRIFT RACER

CROSS REFERENCE TO RELATED APPLICATIONS

This application claims the benefit of U.S. Provisional Application No. 62/160,400, entitled "DRIFT RACER," filed May 12, 2015 which is hereby incorporated by reference in its entirety.

FIELD OF DISCLOSURE

The present disclosure relates generally to the field of amusement parks. More specifically, embodiments of the present disclosure relate to systems and methods utilized to provide amusement park experiences.

BACKGROUND

Various amusement rides have been created to provide passengers with unique motion and visual experiences. For example, theme rides can be implemented with single-passenger or multi-passenger vehicles that travel along a fixed path. In addition to the excitement created by the speed or change in direction of the vehicles as they move along the path, the vehicles themselves may include features providing passengers with varying levels of control (e.g., pedals or various buttons and knobs) over the vehicle. Although a repeat rider may be familiar with the general path of the ride, the control features may create new interest during second and subsequent rides. However, traditional controls given to passengers of a ride vehicle are generally limited when the ride vehicle follows a pre-determined path. Accordingly, it is now recognized that there is a need for an improved amusement ride that provides enhanced passenger control over the ride vehicle to create a more adventurous ride experience.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a passenger vehicle having front wheels, rear wheels, a motor, and a steering wheel, where the front and rear wheels are disposed on a surface, the motor is configured to provide power to the front wheels to propel the passenger vehicle, and the steering wheel is configured to adjust a position of the rear wheels and enable the passenger vehicle to drift, a track forming a trough in the surface, and a bogie hingedly coupled to the passenger vehicle, where the bogie is disposed in the trough, and where the bogie is configured to direct movement of the passenger vehicle along the track.

In accordance with another embodiment, a ride assembly includes a passenger vehicle having front wheels, rear wheels, an electric motor, and a steering system, where the front and rear wheels are disposed on a surface, the electric motor is configured to provide power to the front wheels to propel the passenger vehicle and to provide power to the steering system, the steering system is configured to utilize the power from the electric motor to adjust a position of the passenger vehicle, such that the passenger vehicle may drift, and where the steering system is configured to block the passenger vehicle from drifting beyond a predetermined distance, a track forming a trough in the surface, and a bogie hingedly coupled to the passenger vehicle to enable the passenger vehicle to drift, where the bogie is disposed in the trough, and where the bogie is configured to direct movement of the passenger vehicle along the track.

In accordance with another embodiment, a ride assembly includes a passenger vehicle having front wheels, rear wheels, a steering system, and a receiver, where the front and rear wheels are disposed on a surface, the steering system is configured to adjust a position of the passenger vehicle enabling the passenger vehicle to drift and to block the passenger vehicle from drifting beyond a predetermined distance, and the receiver is configured to detect an emitter disposed on the surface when the passenger vehicle is positioned above the emitter, a track forming a trough in the surface, and a bogie hingedly coupled to the passenger vehicle to enable the passenger vehicle to drift, where the bogie is disposed in the trough, and where the bogie is configured to move the passenger vehicle along the track.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
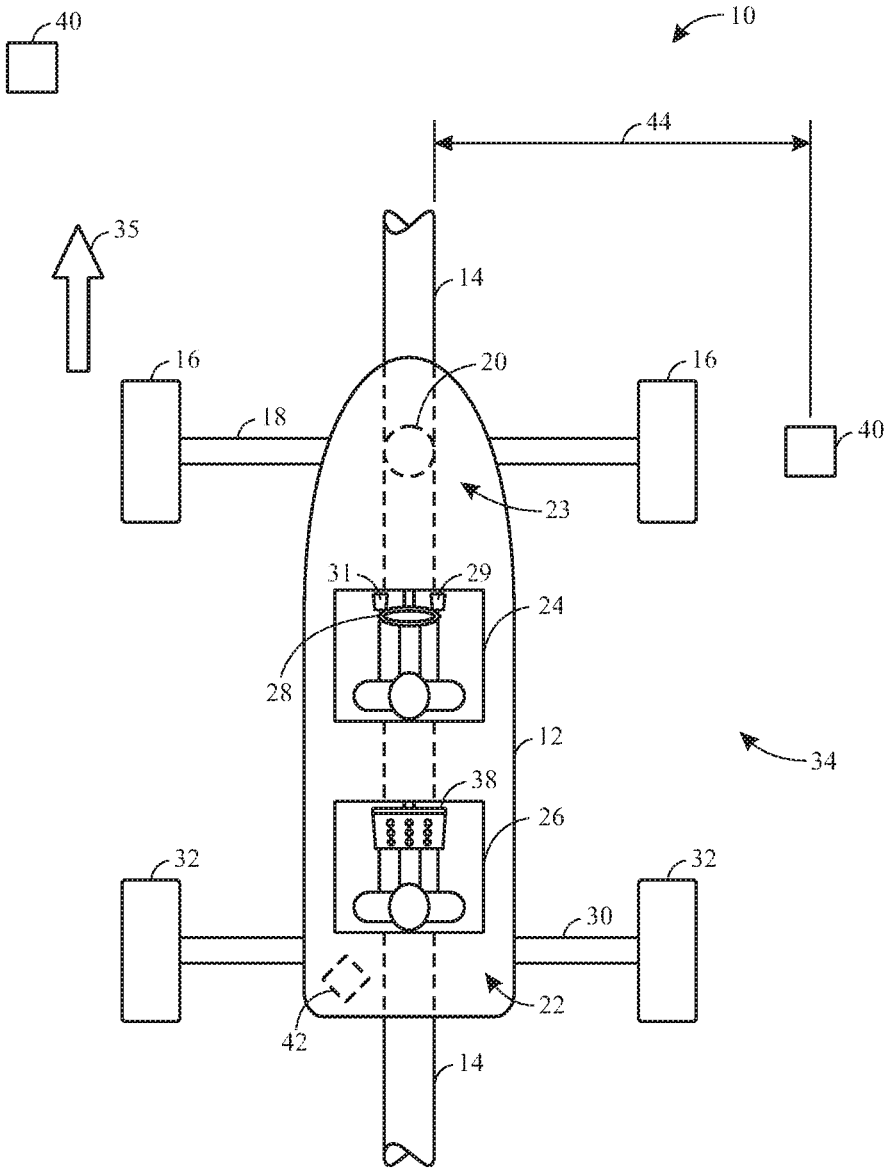
FIG. 1 is a plan view of an embodiment of a drift racer, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments of the disclosure are directed to facilitating a simulated racing attraction that enables riders to have control over various aspects of a racing vehicle. For example, riders may be positioned in a ride vehicle that includes front and rear wheels and that pivots about a column or shaft extending from the vehicle and engaged with a subterranean track. The riders may control the rear wheels using a steering wheel, whereas the ride vehicle may be powered (e.g., driven) by the front wheels. The pivot point of the column or shaft may be positioned proximate the front wheels. Accordingly, the riders may simulate "drifting" (e.g., fishtailing) by controlling a direction of the rear wheels while the front wheels remain in a fixed position. A back end of the ride vehicle may swing out from the direction of the ride vehicle, thereby providing enhanced amusement to the riders. In some embodiments, various targets (e.g., light emitting diodes (LEDs) or other devices configured to emit a signal) may be positioned along a surface over which the ride vehicle moves. The riders may steer the rear wheels in order to cause the ride vehicle to drift in an attempt to position the ride vehicle over the target (e.g., an emitter or a sensor). Further, the ride vehicle may include a receiver that detects when the ride vehicle passes over a target (e.g., an emitter or a sensor), and the receiver may award the rider a point for collecting a target. In certain embodiments, a speed of the ride vehicle may increase as more points are awarded (e.g., the more points received the faster the ride vehicle can go). In other embodiments, points may enable the rider to perform a bounce feature (e.g., actuated mechanisms moving the ride vehicle upwards and downwards with respect to the driving surface and/or track), which may simulate jumping maneuvers.

A ride system in accordance with present embodiments may provide riders with variability of control over actions of the ride system with a high degree of fidelity over steering, vehicle rate of motion, and vehicle position. One or more riders may individually or in coordination control various aspects of the ride vehicle in which they are positioned. Specifically, for example, the one or more riders may control speed, orientation, and position of the assigned ride vehicle within a defined performance envelope. For example, the one or more riders may be able to control the speed of the ride vehicle within a range of speeds and movement of the vehicle within a limited area. These limits (e.g., limited speed range and movement range) may define portions of the performance envelope. Such envelopes for this maneuvering and movement may be provided within numerous block zones along an overall ride path. This may facilitate throughput of the rider through the ride system. For example, numerous ride vehicles may be simultaneously traversing the overall ride path. Accordingly, it may be desirable to avoid having a certain number of vehicles on any one portion of the ride path. The ride path may thus be broken into block zones that are designated to limit a number of vehicles within each block zone. To avoid overpopulating a block zone with vehicles, the performance envelopes of each vehicle may be set such that a vehicle cannot be controlled in a manner that would allow it to catch up to a vehicle in the next block zone. Specifically, for example, if a rider of a first vehicle chooses to operate the first vehicle at a low speed threshold and a rider of a second vehicle (behind the first vehicle along the ride path) chooses to operate the second vehicle at a high speed threshold, the thresholds may be set (in view of an initial separation distance between the two vehicles) such that the two vehicles will never join each other in a single block zone. It should be noted that the thresholds may be dynamically adjusted based on measurements of vehicle locations and so forth. The operational envelopes for vehicles may be set on each individual ride vehicle (e.g., a programmable logic controller (PLC) for each vehicle) or provided by a master controller (e.g., a central PLC) for the ride system.

In certain embodiments, the simulated racing attraction may include an element of competition between riders. For example, riders in two ride vehicles (e.g., one ride vehicle on a first ride track and a second ride vehicle on a second, adjacent ride track) may compete with one another to collect targets and to complete the course in the fastest time. Competition between riders may further enhance enjoyment of the ride and provide motivation to continue to ride the attraction because riders may find enjoyment in racing new opponents.

FIG. 1 is a top view of a race car themed amusement ride assembly 10, in accordance with an aspect of the present disclosure. The ride assembly 10 may include a ride vehicle 12 configured to be guided by a track 14 (e.g., a slot or trough). The ride vehicle 12 may include front wheels 16 (e.g., tires) connected to a front axle 18. The ride vehicle 12 may be connected to a pivot 20 that is positioned above or below the front axle 18, such that the ride vehicle 12 is hingedly coupled to a bogie or other device configured to move along the track 14. Accordingly, a back end 22 of the ride vehicle 12 may rotate while a front end 23 (e.g., the front axle 18 and the front wheels 16) of the vehicle 12 remains substantially fixed with respect to edges of the track 14. The front wheels 16 may be powered by an electric motor (not shown) that receives power generated via movement of the ride vehicle 12. Accordingly, the ride vehicle 12 may be powered (e.g., driven) by the front wheels 16 of the ride vehicle. The electric motor and power generation system will be described in more detail herein with reference to FIG. 5.

As shown in the illustrated embodiment of FIG. 1, the ride vehicle 12 also includes a front passenger seat 24 and a rear passenger seat 26. In other embodiments, the ride vehicle 12 may have a single passenger seat, or it may include more than two passenger seats (e.g., 3, 4, 5, 6, 7, 8, 9, 10, or more). In certain embodiments, the front passenger seat 24 may include a steering wheel 28, an acceleration pedal 29, and a brake pedal 31. The steering wheel 28 (or another steering mechanism) may control movement of a rear axle 30 and rear wheels 32 associated with the rear axle 30. In some embodiments, the rear wheels 32 may be controllably moved independent of the rear axle 30. For example, the rear wheels 32 (e.g., tires) may rotate and/or pivot based on movement of the steering wheel 28. As such, an electric motor (not shown) may be positioned proximate to the rear axle 30 and coupled to the steering wheel 28 to allow for control over the movement of the rear axle 30 and/or the rear wheels 32. In such configurations, the steering wheel 28 may send signals to the electric motor (or a controller or another electronic device) to adjust a position of the rear axle 30 (and/or the rear wheels 32).

Present embodiments are not necessarily limited to the use of the steering wheel 39 in the front passenger seat 24. Indeed, in other embodiments, the steering wheel 28 may be located in the rear passenger seat 26. In still further embodiments, the ride vehicle 12 may not include the steering wheel 28, such that movement of the rear axle 30 (and/or the rear wheels 32) may be pre-determined and thus, not adjustable by the passenger. Additionally or alternatively, other steering input devices (e.g., touch-based or button-based) may be used.

It should be noted that in other embodiments, a position of the front axle 18 may be controlled by the steering wheel 28, such that steering of the ride vehicle 12 is controlled by the front wheels 16. Similarly, the rear wheels 32 may, in addition to or in lieu of the front wheels 16, be powered by an electric motor that generates power via motion of the ride vehicle 12. It should be understood that any combination of front and/or rear wheel drive and front and/or rear wheel steering may be utilized by the ride assembly 10.

Additionally, the passenger may have control over the ride vehicle 12 via the acceleration pedal 29 and the brake pedal 31. For example, the acceleration pedal 29 may enable the passenger to control a speed of the ride vehicle 12. Depressing the acceleration pedal 29 from a default position may cause the electric motor to provide additional power to the front wheels 16, thereby causing the ride vehicle 12 to accelerate. Additionally, the brake pedal 31 may decrease a speed of the ride vehicle 12. In certain embodiments, the brake pedal 31 may be coupled to a brake system that locks the front wheels 16 in place, thereby inhibiting movement and reducing the speed of the ride vehicle 12. It should be noted that in other embodiments, the ride vehicle 12 may not include the acceleration pedal 29 and/or the brake pedal 31, such that the speed of the ride vehicle 12 is substantially predetermined and controlled by an on-board and/or off-board controller operating the electric motor and/or a bogie disposed on a track, for example.

Figure 4:
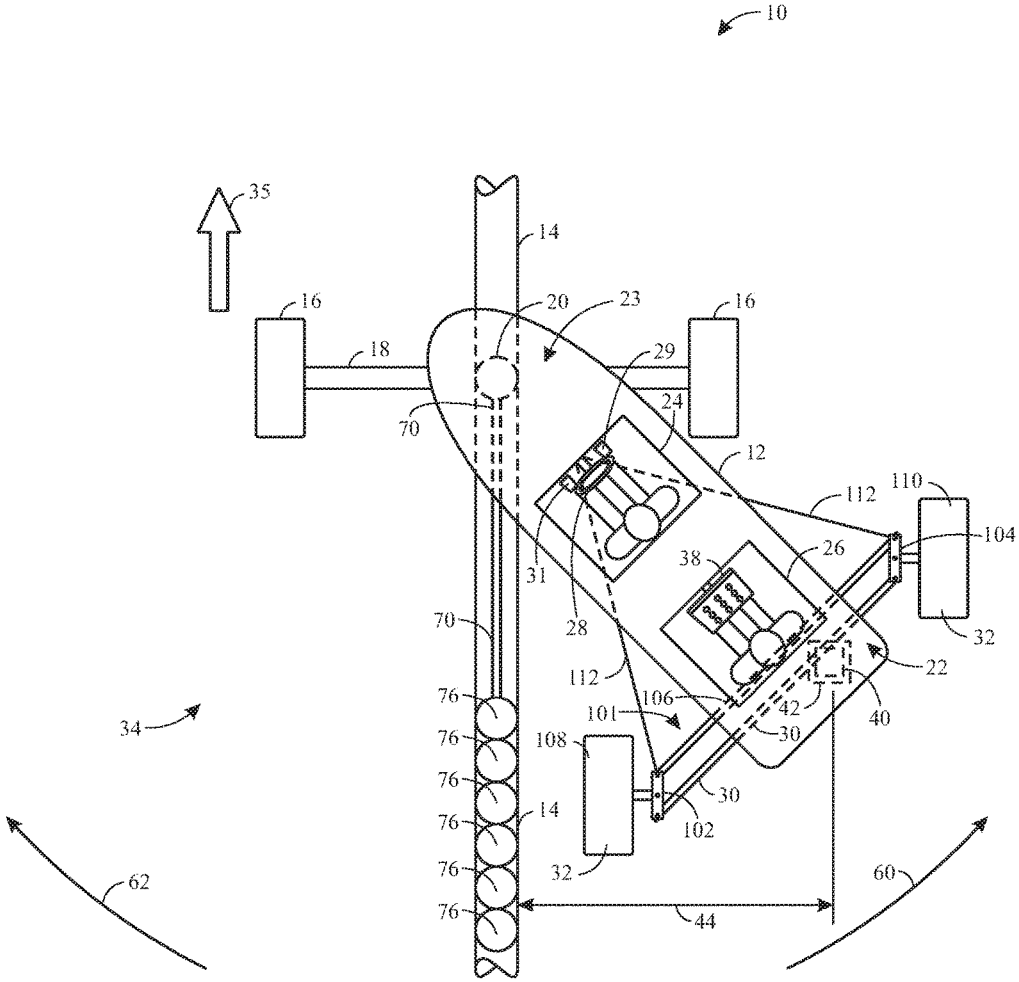
FIG. 4 is section view of an embodiment of a portion of the drift racer of FIG. 1 configured to move using Ackermann steering, in accordance with an aspect of the present disclosure.

Both the front wheels 16 and the rear wheels 32 may be in contact with a surface 34 of the ride 10. Therefore, in the embodiments where the ride vehicle 12 is driven by the front wheels 16, the front wheels 16 may generate movement of the ride vehicle 12. For example, the electric motor may urge the front wheels 16 to spin in a desired direction 35 (e.g., when the passenger depresses the acceleration pedal 29). Due to friction forces between the front wheels 16 and the surface 34, the front wheels 16 propel the ride vehicle 12 in the desired direction 35. Similarly, in embodiments where the ride vehicle is driven by the rear wheels 32, the electric motor may spin the rear wheels 32 in the desired direction and propel the ride vehicle 12 in the desired direction 35. In certain embodiments, the front wheels 16 and the rear wheels 32 contact the surface 34, which may include concrete, asphalt, tar, dirt, or any other suitable material that simulates an actual driving surface (e.g., a road). In other embodiments, the front wheels 16 and the rear wheels 32 may be configured to contact steel plates surrounded by (e.g., embedded in) the surface 34. The steel plates may reduce friction forces between the front wheels 16 and/or the rear wheels 32 to facilitate drifting of the ride vehicle 12 (e.g., a fishtail or when the rear end 22 swings out away from the front end 23). In still further embodiments, the ride assembly may include the steel plates, but the front wheels 16 and the rear wheels 32 contact the surface 34, such that the front wheels 16 and the rear wheels 32 extend outside of the steel plates (e.g., as shown in FIG. 4). Further, a first portion of the front wheels 16 and/or the rear wheels 32 may contact the steel plates and a second portion of the front wheels 16 and/or the rear wheels 32 may contact the surface 34.

The front wheels 16 and the rear wheels 32 contact the surface 34 or the steel plates such that the passengers may perceive the ride vehicle 12 as an actual vehicle (e.g., a car). Although the front wheels 16 and/or the rear wheels 32 may actually propel the ride vehicle 12 in the desired direction 35, the track 14 may ultimately determine a position of the front wheels 16. Therefore, the ride vehicle 12 is urged by the front wheels 16 and/or the rear wheels 32, but the track 14 determines a path in which the ride vehicle 12 ultimately follows (e.g., determines the desired direction 35). In certain embodiments, the passengers may have control over a speed of the ride vehicle 12 (e.g., via the acceleration pedal 29 and the brake pedal 31) as well as over a position of the rear wheels 32 (e.g., an amount of drift of the ride vehicle 12), but the passengers may have limited control over the ultimate course of the ride vehicle 12 (see, e.g., FIG. 11). Additionally, the ride vehicle 12 may enable the passengers to control features that may enhance the overall ride experience.

Figure 6:
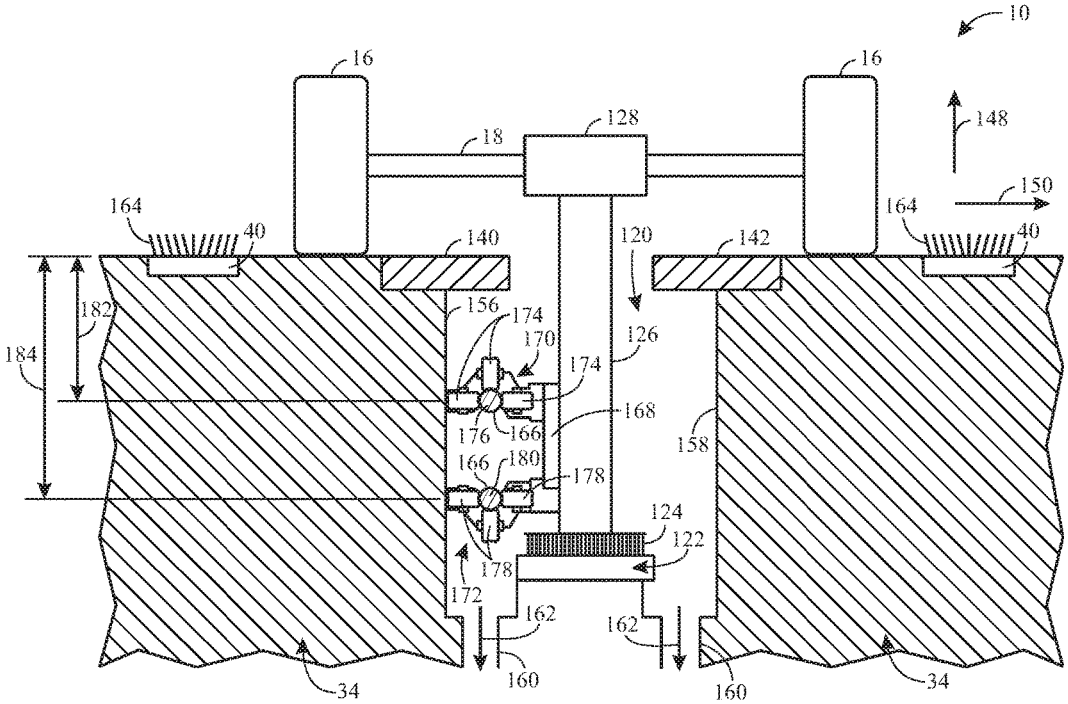
FIG. 6 is a section view of an embodiment of a portion of the drift racer of FIG. 1 that includes first and second bogies configured to direct the drift racer along a ride path defined by a track, in accordance with an aspect of the present disclosure.

As described in more detail below with reference to FIG. 6, in certain embodiments, the track 14 may control the course or path of the ride vehicle 12 as one or more bogies hingedly coupled (e.g., via the pivot 20) to the ride vehicle 12 move along the track 14. The bogie may be coupled to the front axle 18 of the ride vehicle 12 (e.g., via a beam or shaft) and configured such that movement of the ride vehicle 12 may be limited to a course defined by the track 14. The bogie may hingedly couple with the ride vehicle 12 via the pivot 20 and/or may engage different aspects of the ride vehicle 12. The bogie may include various features (e.g., up-stop wheels and/or side guide wheels) that enable the bogie to move along the track 14 as the ride vehicle 12 is propelled forward by the front wheels 16 and/or the rear wheels 32. For example, the bogie may include one or more wheels or ball bearings that slide along the track 14 as the ride vehicle 12 moves in the desired direction 35. Moreover, the bogie may be configured to limit movement of the ride vehicle 12 so that the ride vehicle 12 moves in a path defined by the track 14. The bogie is explained in more detail herein with reference to FIG. 6.

In certain embodiments, the rear passenger seat 26 may include one or more control features 38 enabling a passenger in the rear passenger seat 26 to also have some control over the ride experience. For example, the control features 38 may include one or more control buttons or knobs that perform various functions (e.g., bounce the ride vehicle 12, accelerate or decelerate the ride vehicle 12, or affect performance of another ride vehicle 12 on the track 14 or an adjacent track). One button may enable the ride vehicle 12 to bounce (e.g., via an actuating mechanism or hydraulics), thereby enabling the ride vehicle 12 to move upwards and downwards with respect to the track 14. Certain features of the ride vehicle 12 (e.g., the bounce feature) may be enabled when the ride vehicle 12 passes over an emitter 40 (e.g., radio-frequency (RF) sensor, light emitting diodes (LEDs), a sensor or any other device configured to emit a signal) that awards the passengers a point. For example, the passenger in the front passenger seat 24 may direct the ride vehicle 12 to move via the steering wheel 28 such that the back end 22 passes over the emitter 40. The emitter 40 may be detected by a corresponding receiver 42 disposed on the ride vehicle 12. In certain embodiments, the receiver 42 may be positioned underneath the ride vehicle 12, such that the receiver 42 is blocked from view of the passengers. In other embodiments, the receiver 42 may be positioned in any suitable location on, or within, the ride vehicle 12. In still further embodiments, the receiver 42 may be located on the surface 34 and the emitter 40 may be disposed in a suitable location on or within the ride vehicle 12. Additionally or alternatively, the emitter 40 and/or the receiver 42 may be transceivers configured to both emit and receive signals from one another. In any case, when the receiver 42 detects the emitter 40 (or vice versa), the receiver 42 (or the emitter) may award the passengers a point, thereby enabling the passenger in the rear passenger seat 26 to engage the bounce feature via the control feature 38 (e.g., a button, a knob, or a joystick). It should be noted that while the illustrated embodiment of FIG. 1 shows the front passenger seat 24 having the steering wheel 28 and the rear passenger seat 26 having the control features 38, the steering wheel 28 and the control features 38 may be located in either passenger seat. Further, each seat 24, 26 may be associated with essentially identical controls, which may enable transitioning of rider roles during different phases of a ride or allow a single passenger to control substantially all user inputs associated with the ride vehicle 12.

Positioning the receiver 42 near the emitter 40 may award the passengers a point, thereby activating the bounce feature. In addition to, or in lieu of, the bounce feature, the control features 38 may activate a speed boost of the ride vehicle 12. For example, the passenger in the rear passenger seat 26 may engage the control feature 38, which may cause acceleration of the ride vehicle 12 to occur, which may provide enhanced enjoyment to the passengers. Again, the passenger in the front passenger seat 24 may direct the ride vehicle 12 to pass over the emitter 40, such that the receiver 42 detects the emitter 40 and awards the passengers a point before the control feature 38 (e.g., button enabling the passenger to bounce the ride vehicle 12, boost the ride vehicle 12, or affect another ride vehicle) may be engaged. However, in other embodiments, the passengers may engage the control features 38 without having received any points. For example, the passengers may be able to engage the control features 38 as many times as desired throughout the course of the ride 10 without collecting any points.

The receiver 42 may also be utilized to locate a specific ride vehicle along the track 14, which may enable an operator or an automated controller to determine and/or monitor a location of the ride vehicle 12 relative to other ride vehicles along the track 14. This location function may enable the ride 10 to operate more efficiently.

Figure 2:
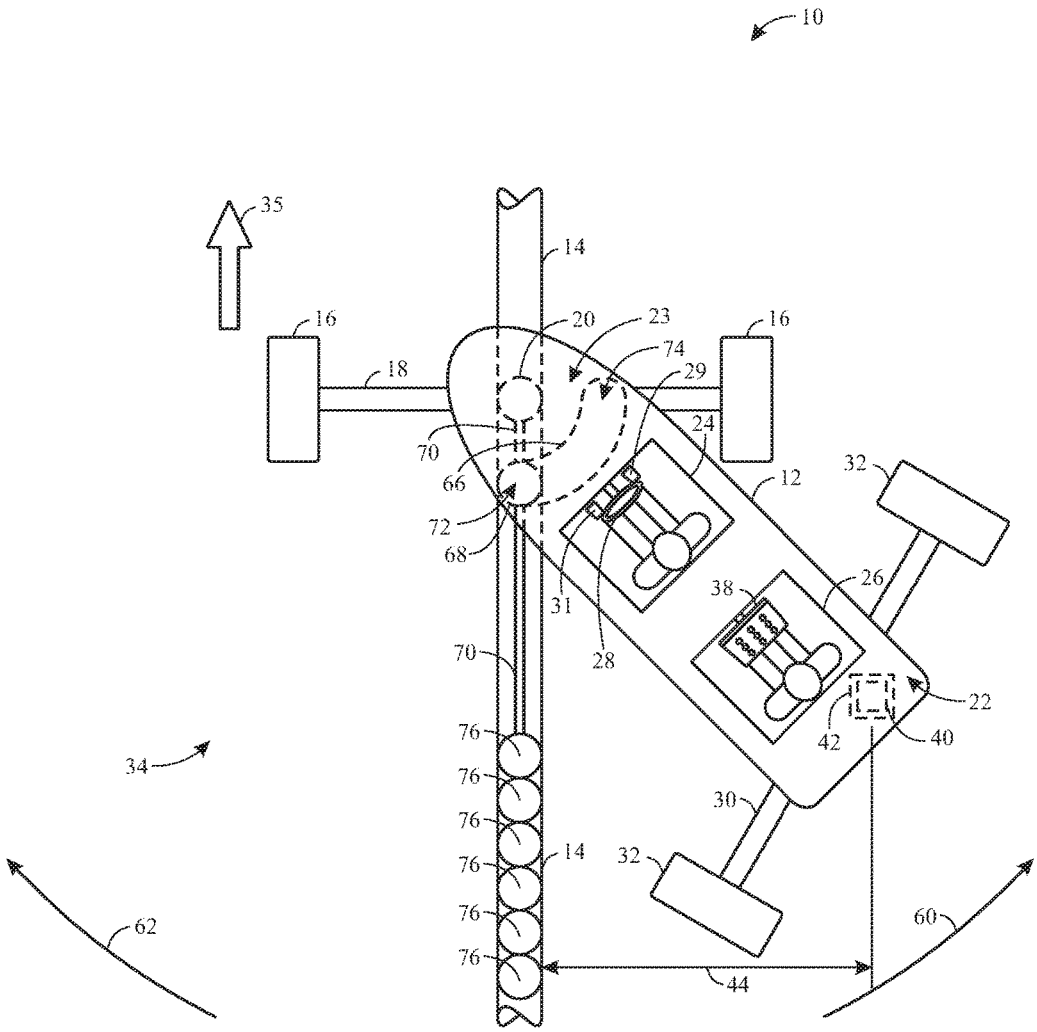
FIG. 2 is a plan view of an embodiment of the drift racer of FIG. 1 that includes a pivot enabling a rear end of the drift racer to swing outwardly away from a track, in accordance with an aspect of the present disclosure.

As illustrated in FIGS. 1 and 2, in certain embodiments, the emitter 40 may be located a distance 44 from the track 14. Therefore, for the receiver 42 to detect the emitter 40, the passengers may utilize the steering wheel 28 to adjust a position of the back end 22, as shown in FIG. 2. For example, the rear axle 30 may be configured to pivot with respect to the ride vehicle 12, but otherwise remain substantially rigid (e.g., a position of the rear axle 30 and the rear wheels 32 do not change with respect to one another). The position of the rear axle 30 may cause the rear end 22 of the ride vehicle 12 to swing outwardly in a direction 60, or a direction 62, away from the track, such that the receiver 42 may be vertically aligned with the emitter 40.

As shown in FIG. 2, the back end 22 of the ride vehicle 12 may swing outwardly in the direction 60 away from the track 14. The pivot 20 enables the rear end 22 of the ride vehicle 12 to swing in the direction 60, while the front end 23 remains aligned with respect to the track 14. Additionally, the front wheels 16 may remain positioned in alignment with the desired direction 35, whereas the rear wheels 32 shift, causing the rear end 22 to swing in the direction 60. The pivot 20 thus enables the ride vehicle 12 to drift while still directing the ride vehicle 12 in the path defined by the track 14. In other words, the overall motion path of the ride vehicle 12 through the ride 10 is preserved, even though portions of the ride vehicle 12 may be allowed to deviate from this path from time to time.

In certain embodiments, the ride vehicle 12 may include a mechanical stop mechanism 66 (e.g., a built-in groove or slot) that blocks the ride vehicle 12 from drifting (e.g., the rear end 22 swinging away from the track 14) beyond a pre-determined distance. Additionally or alternatively, an electronic stop mechanism may be used for this purpose. For example, this may be controlled by a control system (e.g., PLC) and defined limits of operation (e.g., part of a control envelope). Whether controlled by physical mechanisms, a control system, or both, the ride vehicle 12 may be prevented from rotating more than 20 degrees, 25 degrees, 30 degrees, 45 degrees, or 60 degrees about the pivot 20 to enhance ride control and to avoid undesired contact between components of the ride assembly 10. The stop mechanism 66 may include a slot or groove in the ride vehicle 12 that is configured to receive a shaft 68 engaged directly or indirectly with the track 14 (e.g., in the illustrated embodiment, the shaft 68 protrudes vertically from a bogie disposed in the track 14). In certain embodiments, the shaft 68 may be coupled to the bogie (e.g., via the shaft or beam connecting the bogie to the front axle 18) disposed in the track 14. Therefore, the shaft 68 may be configured to move along the path defined by the track 14, but to remain substantially stationary with respect to the rear end 22 of the ride vehicle 12. The shaft 68 may be coupled to the bogie via a connecting rod 70. In certain embodiments, the connecting rod 70 may be substantially aligned with the track 14 and be configured to move along the track. For example, the connecting rod 70 may include a single, flexible rod that may maneuver through turns in the course of the track 14. In other embodiments, the connecting rod 70 may include multiple rods coupled to one another to enhance the flexibility (e.g., several smaller rods coupled together via hinges) of the connecting rod 70.

By coupling the shaft 68 to the bogie, the movement of the ride vehicle in the direction 60 and the direction 62 may be limited. As the rear end 22 of the ride vehicle 12 swings outwardly in the direction 60, the stop mechanism 66 may move about the shaft 68. The stop mechanism 66, however, may include a first end 72 and a second end 74 that limit movement of the ride vehicle 12 in the directions 60 and 62. For example, as the ride vehicle 12 moves in the direction 60, the stop mechanism 66 moves about the shaft 68 until it reaches the first end 72. At the first end 72, the shaft 68 engages an edge of the stop mechanism 66 and physically blocks further movement of the ride vehicle 12 in the direction 60. Therefore, the stop mechanism 66 prevents the ride vehicle 12 from drifting beyond a pre-determined point.

In certain embodiments, the ride 10 may also include slot fillers 76 that cover the slot of the track 14 and facilitate a smooth transition of the rear wheels 32 over the track 14. Thus, the slot fillers 76 essentially prevent the track 14 from inhibiting movement of the ride vehicle 12 in the direction 60 or the direction 62. For example, the slot fillers 76 may be configured to be substantially flush with the surface 34 (or the steel plates) so that the rear wheels 32 smoothly transition from one side of the track 14 to another when drifting. The slot fillers 76 may be coupled to the bogie and/or the shaft 68 via the connecting rod 70 (e.g., a substantially rigid rod or a flexible rod, such as a cable), or via another connecting feature (e.g., a second connecting rod). In the illustrated embodiment, the track 14 includes six slot fillers 76. However, any number of slot fillers may be used. For example, in other embodiments, the track 14 may include a single slot filler 76 that covers an area that is substantially equal to the rear wheels 32. In still further embodiments, the track 14 may include more than six slot fillers 76 (e.g., 7, 8, 9, 10, or more). In some cases, more slot fillers may facilitate movement of the slot fillers 76 along the track 14 (e.g., smaller slot fillers 76 placed side by side may enable the track 14 to include tighter turns). In still further embodiments, the track 14 may include any suitable number of slot fillers 76 that prevent the rear wheels 32 from experiencing a significant obstacle to drifting while enabling the track 14 to include tight turns for the enjoyment of the passengers. Additionally, in some embodiments, the track 14 may be narrow enough that the track 14 does not create an obstacle to the rear wheels 32. In such embodiments, the track 14 may not include the slot fillers 76.

Figure 3:
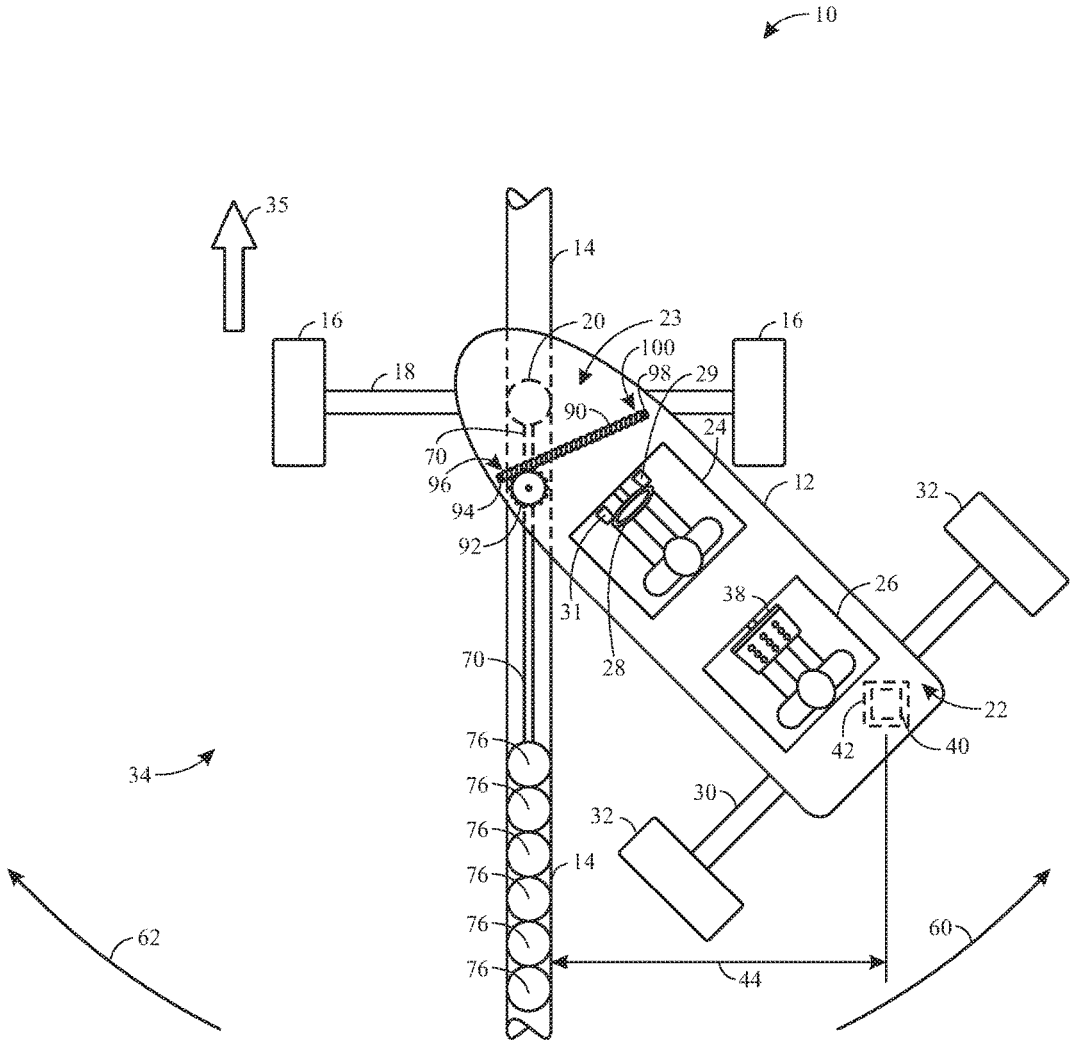
FIG. 3 is a plan view of an embodiment of the drift racer of FIG. 1 that includes a threaded rod and a gear configured to enable the rear end of the drift racer to swing outwardly away from the track in a controlled manner, in accordance with an aspect of the present disclosure.

FIG. 3 illustrates another embodiment of the stop mechanism 66 of the ride assembly 10. As shown in the illustrated embodiment, the ride vehicle 12 includes a threaded rod 90. Additionally, the shaft 68 may have a gear 92 coupled to an end of the shaft 68 configured to rotate as the rear end 22 of the ride vehicle 12 moves in the direction 60 or 62. The threaded rod 90 may include a first stop 94 on a first end 96 of the threaded rod 90 and a second stop 98 on a second end 100 of the threaded rod 90. The first and second stops 94, 98 may be configured to prevent the gear 92 from rotating when the gear 92 contacts the first and second ends 96, 100 respectively. Therefore, the threaded rod 90 and the shaft 68 having the gear 92 may be configured to perform substantially the same function as the stop mechanism 66 (e.g., to prevent the ride vehicle 12 from drifting beyond a certain point). The threaded rod 90 and the gear 92 may be configured to control a speed of transition between the first and second ends 92, 100 (e.g., include varying distances between teeth or threads).

Further, in certain embodiments, the gear 92 may be coupled to an electric motor that drives rotation of the gear 92 (e.g., the gear 92 does not spin freely). In such embodiments, the electric motor driving the gear 92 may create the drifting effect of the ride vehicle 12. For example, as the passenger moves the steering wheel 28, the electric motor may rotate the gear 92, thereby moving the rear end 22 of the ride vehicle 12 in the direction 60 or the direction 62. Accordingly, in the illustrated embodiment, the drifting action of the ride vehicle 12 may be controlled using the gear 92 and the threaded rod 90, either in lieu of or in addition to using a motor to move the rear axle 30. Therefore, in some embodiments, the electric motor configured to adjust a position of the rear axle 30 may be removed from the ride vehicle 12 because a position of the rear axle 30 may not be adjusted to cause the ride vehicle 12 to drift. Therefore, the threaded rod 90 and gear 92 configuration illustrated in FIG. 3 may possess dual functionality (e.g., creating drifting while also limiting an amount of drift that can occur).

In some embodiments, as shown in FIG. 4, the ride vehicle 12 may be configured to drift using an Ackermann steering system 101. More particularly, FIG. 4 is a section view of an embodiment of the ride assembly 10 that includes the Ackermann steering system 101. As used herein, the Ackermann steering system 101 may adjust an angle of the rear wheels 32 with respect to the surface 34 to direct movement of the ride vehicle 12. For example, the rear axle 30 may be coupled to a first steering arm 102, a second steering arm 104, and/or a moveable rod 106. The first steering arm 102 may be coupled to the rear axle 30 proximate a first rear wheel 108 and the second steering arm 104 may be coupled to the rear axle 30 proximate a second rear wheel 110. Additionally, the first steering arm 102 and the second steering arm 104 may be coupled to one another with the moveable rod 106. In some embodiments, the first steering arm 102 and/or the second steering arm 104 may be coupled to the steering wheel 28 via cables 112. Accordingly, as the steering wheel 28 is moved (e.g., by the passenger in the front passenger seat 24), the cables 112 may adjust a position of the first steering arm 102 and the second steering arm 104, thereby causing the rear wheels 32 to pivot with respect to the rear axle 30. When the rear wheels 32 pivot, the ride vehicle 12 may move in the direction 60 and/or the direction 62. Regardless of how drifting is simulated in the ride assembly 10, the track 14 may include various features to align the ride vehicle 12 with the track 14 and to direct the ride vehicle 12 along a desired path defined by the track 14.

Figure 5:
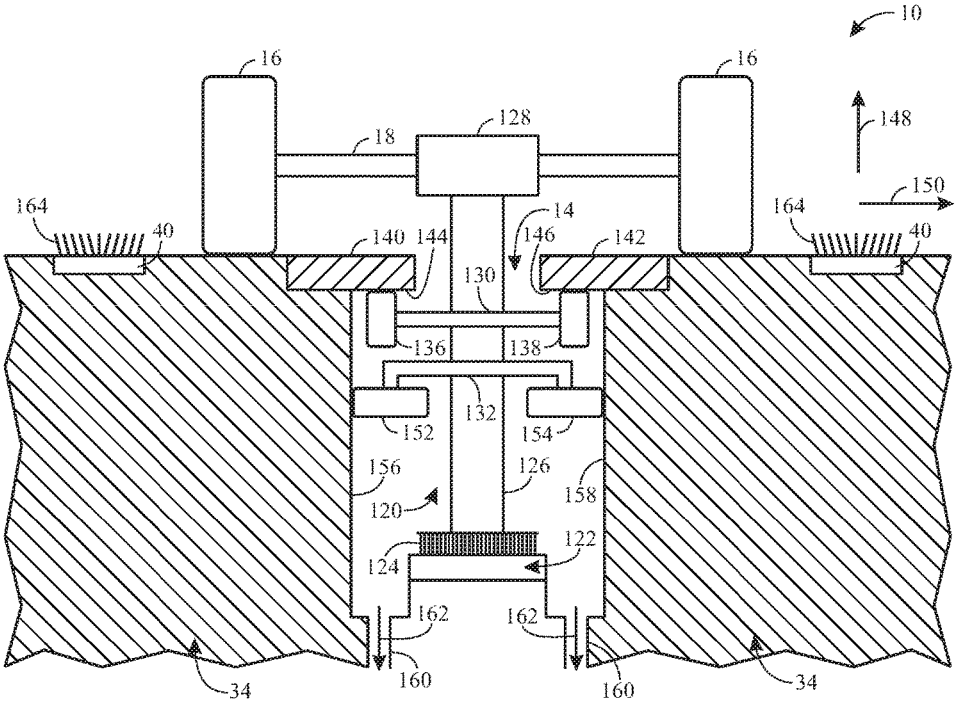
FIG. 5 is a section view of an embodiment of a portion of the drift racer of FIG. 1 that includes first and second bogies configured to direct the drift racer along a ride path defined by a trough, in accordance with an aspect of the present disclosure.

FIG. 5 illustrates a section view of the track 14 and a portion of the ride vehicle 12, in accordance with aspects of the present disclosure. The track 14 may include a trough 120 that is configured to receive various components of the ride assembly 10. The trough 120 may house a power strip 122 that is configured to contact a brush 124 (e.g., a conductive metal) coupled to a shaft 126 of the ride assembly 10. As the ride vehicle 12 moves along the track 14, the brush 124 may contact the power strip 122, thereby receiving electric current. In certain embodiments, the electric current received via the power strip 120 may power an electric motor 128. The electric motor 128 may be coupled to the front axle 18 and be configured to provide power to the front wheels 16, such that the front wheels 16 spin and generate movement in the desired direction 35. It should be noted that while the illustrated embodiment of FIG. 5 shows the electric motor 128 receiving power from the brush 124 and electric power strip 122, alternative embodiments of the ride assembly 10 may include a gas powered motor or a battery powered motor. Further, the ride vehicle 12, specifically the electric motor 128, may receive power (e.g., from the electric power strip 122) via induction plates. For example, in one embodiment, a linear induction motor may be employed. In still further embodiments, crane brushes may be utilized to generate power from the electric power strip 122.

As shown in the illustrated embodiment of FIG. 5, the shaft 126 may be coupled to a first bogie 130 and a second bogie 132, which combine to form a bogie assembly 133. In certain embodiments, the first bogie 130 may include a first up-stop wheel 136 and a second up-stop wheel 138. The up-stop wheels 136, 138 may be configured to contact a first steel plate 140 and a second steel plate 142, respectively, during movement of the ride vehicle 12 in the desired direction 35. For example, the first up-stop wheel 136 may contact a first lower face 144 of the first steel plate 140, and the second up-stop wheel 138 may contact a second lower face 146 of the second steel plate 142. In other embodiments, the up-stop wheels 136, 138 may be configured to contact the surface 34 (e.g., via a ledge or groove). The up-stop wheels 136, 138 of the first bogie 130 may provide a clamping force to the ride vehicle 12. For example, the up-stop wheels 136, 138 may be configured to maintain contact between the front wheels 16 and the surface 34 and/or the steel plates 140, 142. Accordingly, substantial movement of the ride vehicle 12 and the front wheels 16 in a vertical direction 148 may be prevented by the first bogie 130.

Similarly, the second bogie 132 may be configured to prevent substantial movement of the front end 23 of the ride vehicle 12 in a horizontal direction 150. For example, in certain embodiments, the second bogie 132 may include a first side guide wheel 152 and a second side guide wheel 154. The first side guide wheel 152 may be configured to contact a first side 156 of the trough 120 and the second side guide wheel 154 may be configured to contact a second side 158 of the trough 120. Accordingly, the shaft 126 remains substantially centered within the trough 120 such that the front axle 18 and front wheels 16 may not experience any inadvertent movement in the horizontal direction 150 (e.g., the front wheels 16 and the front axle 18 remain substantially centered with respect to the track 14 despite movement of the rear end 22 of the ride vehicle 12).

In certain embodiments, the first and second bogies 130, 132 may include a telescope configuration to facilitate installation and/or removal of the first and second bogies 130, 132 from the trough 120. In other embodiments, the first and second bogies 130, 132 may include another suitable collapsible configuration to facilitate installation and/or removal from the trough 120. In still further embodiments, the first and second bogies 130, 132 may be coupled (e.g., welded) to the shaft 126 after the shaft 126 has been disposed in the trough 120 of the track 14. In some embodiments, the track 14 may include an access bay for receiving and removing the bogie assembly 133.

In certain embodiments, the ride assembly 10 may be constructed in an outdoor environment. Accordingly, water may accumulate in the trough 120 as a result of rain, snow, or the like. Therefore, the trough 120 may include one or more drains 160 that are configured to remove water and other undesirable components from the trough 120. For example, the drains 160 may receive water as it is disposed in the trough 120 and direct (e.g., via gravity or a pump) the water in a direction 162 toward an outlet. In other embodiments, the drains 160 may direct water toward a collection device (e.g., a pool or a container) where the water is then pumped away from the track 14 towards a sewer, for example. The drains 160 may prevent substantial buildup of water in the trough 120 so that the bogies 130, 132 may operate effectively and so that electricity may be generated via the power strip 122 and the brush 124.

Additionally, FIG. 5 illustrates two emitters 40 disposed in (e.g., embedded in) the surface 34. In other embodiments, the emitters 40 may be disposed on (e.g., protrude from) the surface 34. In any event, the emitters 40 may be configured to emit a signal 164 that may be detected by the receiver 42 disposed on the ride vehicle 12. As discussed above, the passengers may be awarded a point for controlling the ride vehicle 12 (e.g., drifting) such that the receiver 42 passes over the emitter 40 and detects the signal 164.

In other embodiments, it may be desirable to utilize guide tracks 166 that may be configured to direct the ride vehicle 12 in the desired direction 35 rather than the steel plates 140 and 142 and/or the sides 156 and 158 (e.g., walls) of the recess 120. For example, FIG. 6 is a section view of the track 14 and a portion of the ride vehicle 12 coupled to the guide tracks 166 that may be disposed in, and extend throughout, the trough 120. As shown in the illustrated embodiment of FIG. 6, the shaft 126 may be coupled to a bogie assembly 168 that includes a first bogie 170 and a second bogie 172. The first bogie 170 may include first wheels 174 that are coupled to one another and configured to move along a first guide track 176 of the guide tracks 166. Similarly, the second bogie 172 may include second wheels 178 coupled to one another and configured to move along a second guide track 180 of the guide tracks 166. Accordingly, the ride vehicle 12 may be directed in the desired direction 35 by the guide tracks 166. Utilizing the guide tracks 166 may enable the shaft 126 to remain substantially stationary with respect to the trough 120 (e.g., the first guide track 176 and the second guide track 180 are positioned at substantially constant depths 182 and 184, respectively, throughout the trough 120). Such a configuration may be desirable so that bumps or other inadvertent movement caused by imperfections in the steel plates 140 and 142 and/or the sides 156 and 158 of the trough 120 may be mitigated or avoided. It should be noted that while one or more of the wheels 174 and/or 178 contact the side 156 of the trough 120 in the illustrated embodiment of FIG. 6, in other embodiments, the wheels 174 and/or wheels 178 may not contact the side 156 and/or side 158 of the trough 120.

Figure 7:
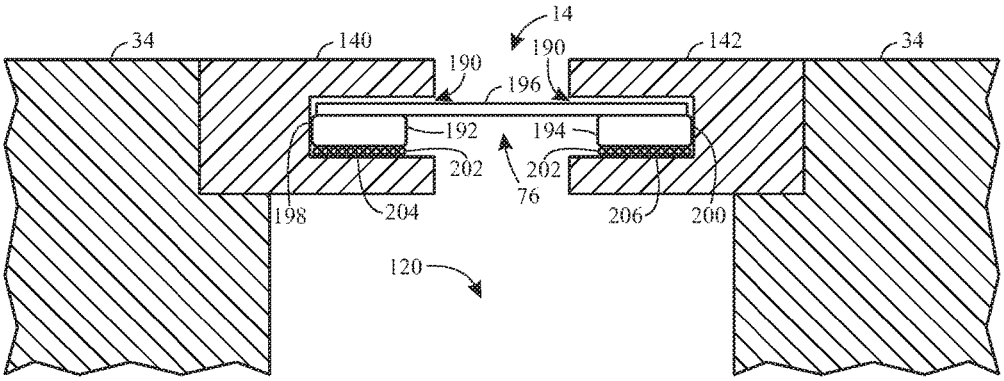
FIG. 7 is a section view of an embodiment of the drift racer of FIG. 1 that includes a slot filler disposed on a wheel driven by ball bearings, in accordance with an aspect of the present disclosure.

Referring briefly again to FIGS. 2 and 3, when the rear end 22 of the ride vehicle 12 drifts (e.g., swings outwardly in direction 60), the rear wheels 32 may pass over the track 14, and therefore, the trough 120. Accordingly, the rear wheels 32 may experience an obstruction when moving across the track 14 (e.g., along a travel path) as a result of the break in the surface 34. To mitigate any obstruction to movement in the direction 60, the ride 10 may include the slot fillers 76. FIG. 7 illustrates a cross section view of an embodiment of the slot fillers 76 disposed in a groove 190 of the steel plates 140, 142. It should be noted that while the groove 190 is illustrated within the steel plates 140, 142, the ride assembly 10 may not include the steel plates 140, 142, and the groove 190 may be disposed directly in the surface 34.

The slot fillers 76 may include a first wheel 192 and a second wheel 194. In certain embodiments, the first and second wheels 192, 194 may be coupled via a disc 196. Additionally, the first and second wheels 192, 194 may be configured to contact a first vertical surface 198 of the groove 190 and a second vertical surface 200 of the groove 190, respectively. Therefore, ball bearings 202 may be exposed (e.g., coupled to) beneath the first and second wheels 192, 194 to facilitate movement of the first and second wheels 192, 194 along a first horizontal surface 204 of the groove 190 and a second horizontal surface 206 of the groove 190, respectively. As the ride vehicle 12 moves in the desired direction 35, the first and second wheels 192, 194, and thus the disc 196, may be urged along the track 14. Moreover, coupling the disc 196 to the connecting rod 70 may enable the disc 196 to remain substantially in alignment with the rear wheels 32 such that the disc 196 may cover the trough 120 throughout the entire length of the track 14. It should be noted that the groove may be positioned in the steel plates 140, 142, such that the disc 196 is substantially flush with the steel plates 140, 142 and/or the surface 34 to enable a smooth transition when the rear wheels 32 move along a travel path in the direction 60 when drifting occurs. In some embodiments, ball bearings 202 may engage side, upper, and/or lower walls of the grooves 190.

While FIG. 7 illustrates a single disc 196 having the wheels 192, 194, multiple discs 196 may be coupled in series to increase an area that fills (e.g., covers) the trough 120 preventing the rear wheels 32 from falling into the trough 120 when the wheels move along a travel path in the direction 60 during drifting. For example, the ride assembly 10 may include 2, 3, 4, 5, 6, 7, 8, 9, 10, or more discs 196 coupled in series to increase the area covering the trough 120. However, it should be understood that any suitable number of discs 196 may be included to substantially mitigate obstruction caused by the trough 120 to the rear wheels 32.

Figure 8:
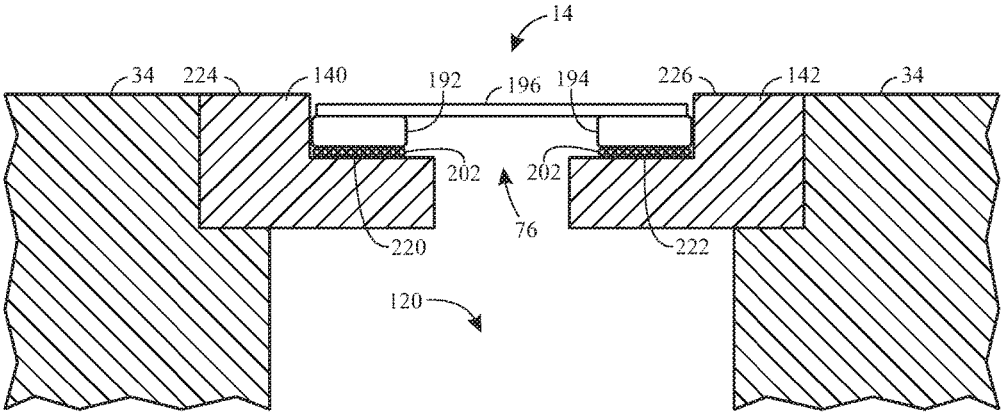
FIG. 8 is a section view of an embodiment of the slot filler of FIG. 7 at another position within the trough, in accordance with an aspect of the present disclosure.

FIG. 8 illustrates a cross section view of another embodiment of the groove 190 in the steel plates 140, 142. As shown in the illustrated embodiment, the steel plates 140, 142 include a first ledge 220 and a second ledge 222, respectively. Accordingly, the first wheel 192 may be configured to move along the first ledge 220 and the second wheel 194 may be configured to move along the second ledge 222. In the illustrated embodiment of FIG. 8, the disc 196 may be positioned substantially flush with a top surface 224 of the steel plates 140, 142. In certain embodiments, the top surface 224 of the plates 140, 142 may be flush with the surface 34 to form a smooth transition between the steel plates 140, 142 and the surface 34. Therefore, including the slot fillers (e.g., the wheels 192, 194 and the disc 196) may enable a smooth transition when the rear wheels 32 move along a travel path in the direction 60 when drifting occurs.

Figure 9:
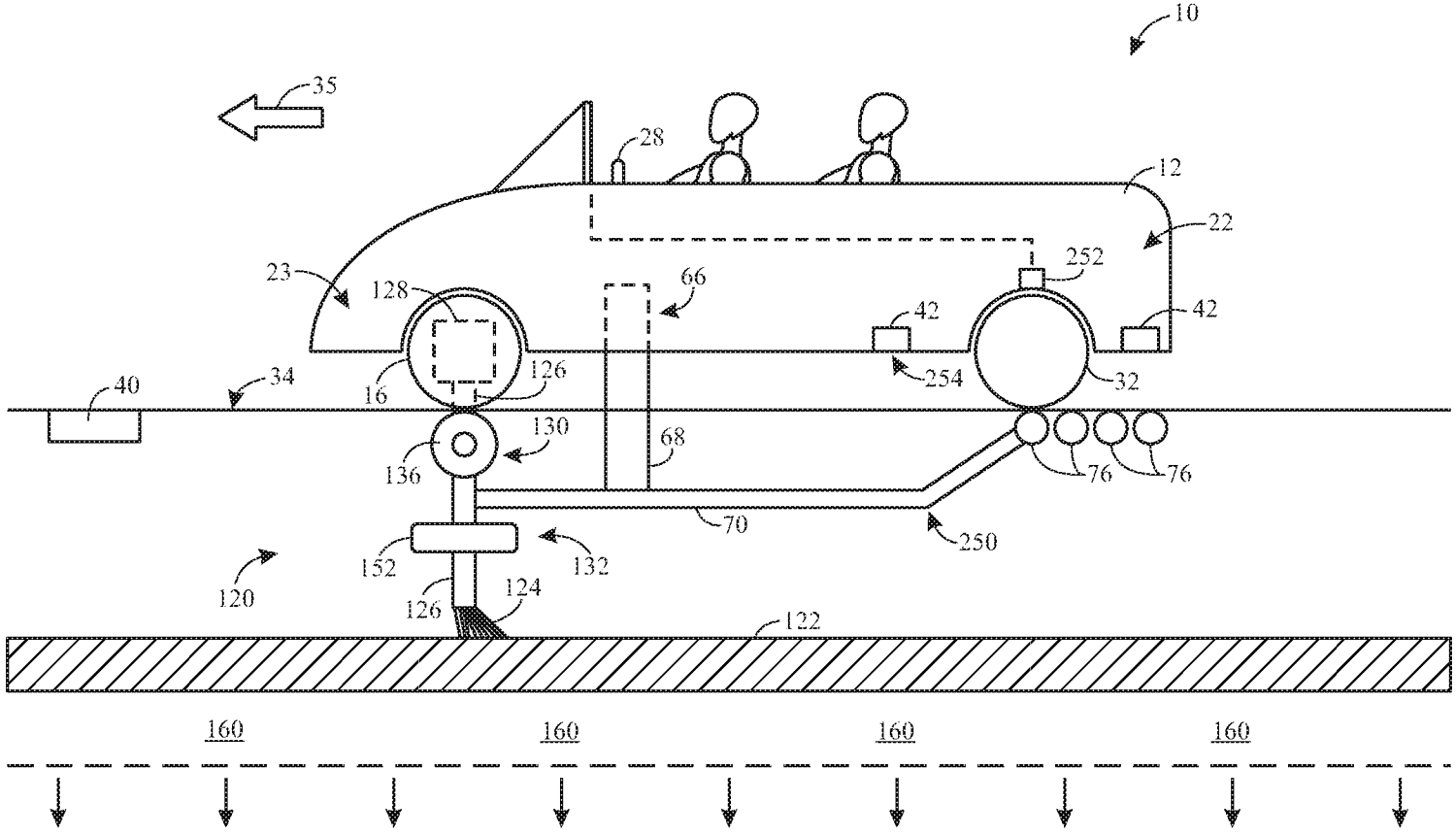
FIG. 9 is an elevation view of an embodiment of the drift racer of FIG. 1, in accordance with an aspect of the present disclosure.

FIG. 9 is a side view of the ride assembly 10, in accordance with aspects of the present disclosure. As illustrated in FIG. 9, the ride vehicle 12 may move in the desired direction 35 along the surface 34. The front wheels 16 may be driven (e.g., urged to spin in the desired direction) by the electric motor 128. As discussed previously, the electric motor 128 may receive power via the brush 124 contacting the electric power strip 122. The brush 124 may be coupled to the shaft 126. In certain embodiments, the shaft 126 includes conductive wires that couple the brush 124 and the electric motor 128. In other embodiments, the shaft 126 may include any other suitable electrical connections to transfer electric current from the brush 124 to the electric motor 128. It should be noted that, in other embodiments, the ride vehicle 12 may be propelled by the electric power strip 122 providing power to aspects of the bogie assembly 133 (e.g., driving a motor of the bogie assembly 133 that forces rotation of wheels of the bogie assembly 133) rather than the front wheels 16 receiving power from the electric motor 128.

In embodiments where the ride assembly 10 is located in an outdoor environment, the drains 160 may be desirable to avoid water accumulation in the trough 120 so that the electric current may be generated by the brush 124 and the electric power strip 22. FIG. 9 illustrates the drains 160 disposed in the trough 120 of the track 14. As discussed previously, the drains 160 may direct water that would otherwise collect (e.g., pool) within the trough 120 to another location (e.g., a container, a sewer, an outlet). The drains 160 may be desirable to prevent water accumulation in the trough and to prevent any potential damage to the ride assembly 10 (e.g., rust, cause a short circuit, remove lubrication from moving parts).

The first and second bogies 130, 132 may also be coupled to the shaft 128. As shown in the illustrated embodiment of FIG. 9, the first up-stop wheel 136 may contact the surface 34 (or the steel plate 140) and provide a clamping force, such that the front wheels 16 remain in contact with the surface 34 (or the steel plates 140, 142) throughout the course of the track 14. Additionally, the first side guide wheel 152 may contact the first side 156 of the trough 120 to substantially center the ride vehicle 12 over the trough 120 throughout the course of the track 14. The up-stop wheel 136 and the side guide wheel 152, together, act to guide the ride vehicle 12 along the track 14 despite the front wheels 16 propelling movement of the ride vehicle 12.

The connecting rod 70 may also be coupled to the shaft 128. In certain embodiments, the connecting rod 70 is a single beam or rod that can bend and move (e.g., a flexible beam or rod) with the path defined by the track. In other embodiments, the connecting rod 70 may include multiple rods coupled to one another in series (e.g., via hinges) that enable the connecting to rod to have enhanced flexibility. The shaft 68 may be coupled to the connecting rod 70 and be substantially perpendicular to the connecting rod 70. As discussed above, the shaft 68 may be configured to fit inside the stop mechanism 66 to limit the distance in which the ride vehicle 12 may drift (e.g., the rear end 22 swinging away from the track 14). Additionally, the slot fillers 76 may be coupled to the connecting rod 70. As shown in the illustrated embodiment, the connecting rod 70 includes a bend 250 that positions the slot fillers 76 flush with the surface 34 (or the steel plates 140, 142). However, in other embodiments, the connecting rod 70 may be coupled to the shaft 128 at a position substantially flush with (or even slightly above) the surface 34, such that the bend 250 is not included. As discussed previously, it may be desirable to position the slot fillers 76 flush with the surface 34 (or the steel plates 140, 142) so that the rear wheels 32 may slide (e.g., drift) over the track 14 (e.g., along a travel path in the direction 60) without any significant obstruction (e.g., the rear wheels 32 falling into the trough 120).

In order for the rear wheels 32 to slide over the track 14, the ride vehicle 12 may include the steering wheel 28 that enables the passengers to adjust a position of the rear axle 30, and thus, the rear wheels 32. For example, the passenger in the front passenger seat 24 may turn the steering wheel 28 so that the ride vehicle 12 may drift and position the receiver 42 over the emitter 40 to collect a point. Therefore, the steering wheel 28 may be coupled to an electric motor 252 that adjusts the position of the rear axle 30, and thus the rear wheels 32, to enable the ride vehicle 12 to drift.

The passengers may find drifting the ride vehicle 12 desirable because it may provide enhanced amusement to the passengers as the ride vehicle 12 swings in the direction 60 and/or 62. Additionally, drifting the ride vehicle 12 may enable the passengers to collect points, which may activate various bonus features (e.g., the bounce feature and/or the boost feature). In certain embodiments, the ride vehicle 12 may include the receiver 42 positioned near the rear wheels 32. In other embodiments, the ride vehicle 12 may include the receiver 42 positioned near a center 254 of the ride vehicle. In still further embodiments, the ride vehicle 12 may include more than one receiver 42 positioned in any suitable location. For example, the ride vehicle 12 may include any suitable number of receivers 42 positioned on the ride vehicle 12 so that detection of the emitter 40 may occur when the ride vehicle 12 passes over the emitter 40. As discussed previously, points may enable the passengers to activate the bounce feature.

Figure 10:
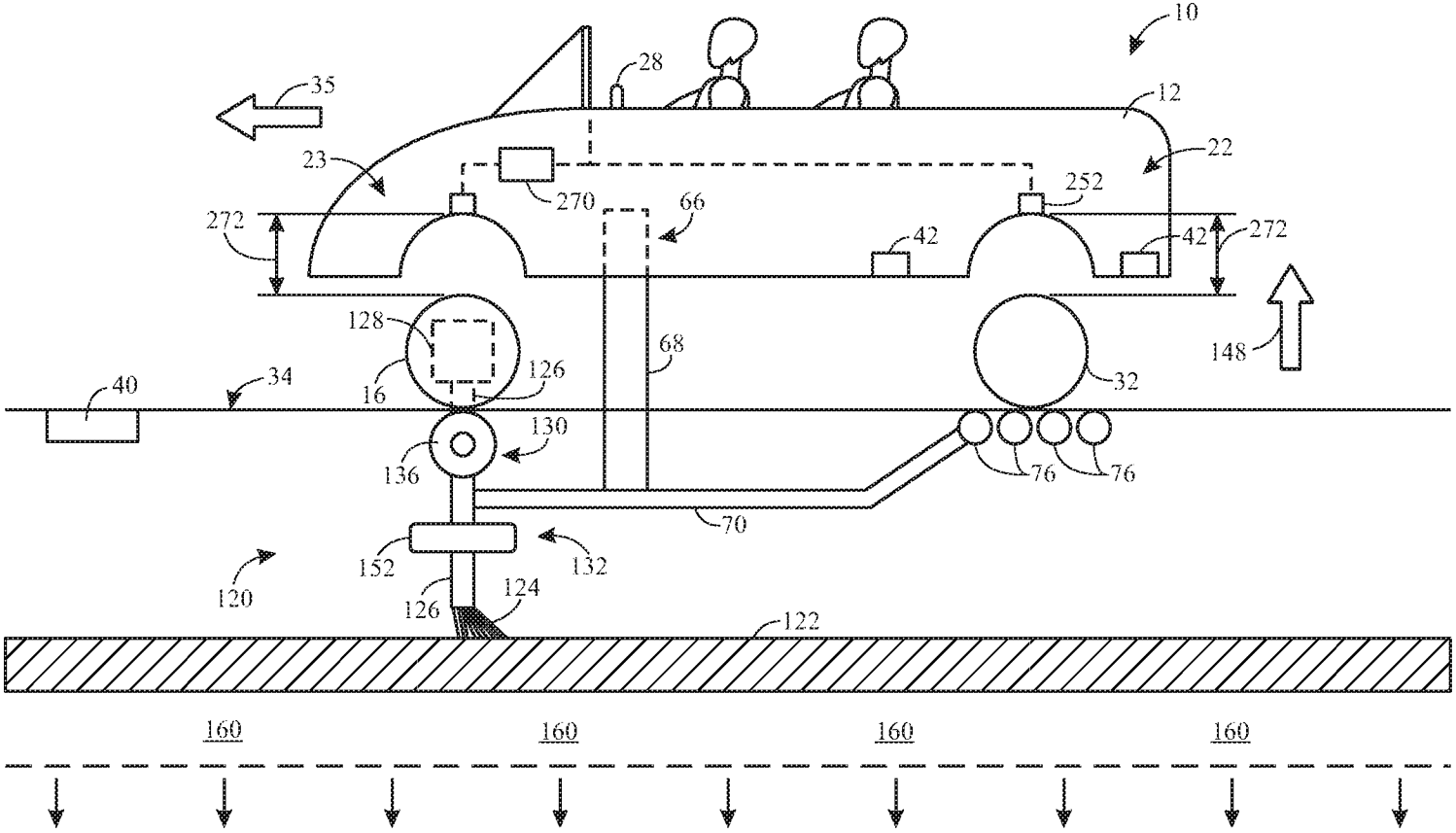
FIG. 10 is an elevation view of the drift racer of FIG. 9 in a lifted position, in accordance with an aspect of the present disclosure.

FIG. 10 is a side view of the ride assembly 10 showing movement of the ride vehicle 12 in the vertical direction 148 as a result of the bounce feature. In certain embodiments, when the passengers receive a point, or a threshold amount of points (e.g., two points, three points, or more than three points), the bounce feature may be activated. Accordingly, the passenger in the rear passenger seat 26 may press a button to initiate the bounce feature. When the bounce feature is initiated, an actuating mechanism 270 (e.g., hydraulics) may drive the ride vehicle 12 to move in the vertical direction 148 such that the ride vehicle 12 is a distance 272 above the front wheels 16 and the rear wheels 32. In certain embodiments, the bounce feature may enable the ride vehicle 12 to continuously move up and down (e.g., bounce) in the vertical direction 148 for a predetermined amount of time (e.g., 15 seconds).

Additionally, when the bounce feature is activated, the passengers may no longer possess control over the rear axle 30, such that drifting may not occur. In other embodiments, the shaft 68 and the stop mechanism 66 may be configured to remain in contact as the ride vehicle 12 moves in the vertical direction 148 such that control over the rear axle 30 may remain enabled and drifting may occur even when bouncing.

Figure 11:
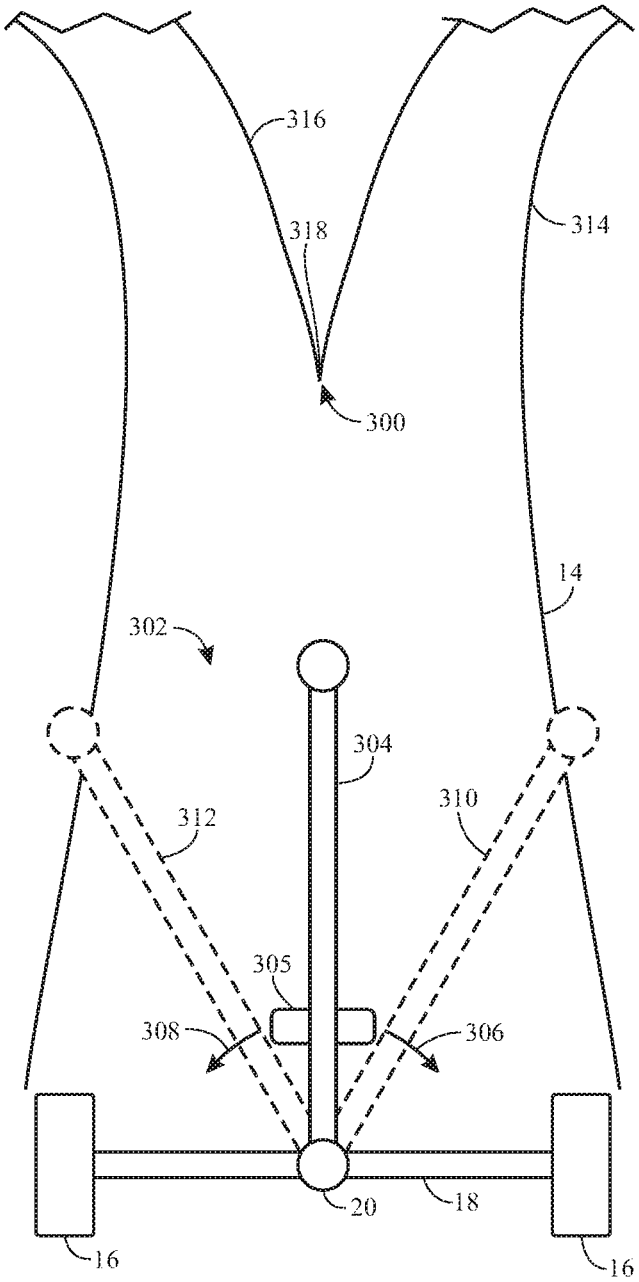
FIG. 11 is a plan view of an embodiment of the drift racer of FIG. 9 along a track that may include a junction, in accordance with an aspect of the present disclosure.

In addition to controlling a position of the rear end 22 using the steering wheel 28, a passenger may also control which path the ride vehicle 12 takes when a junction is placed along the track 14. FIG. 11 shows an embodiment of the track 14 having a binary junction 300 and a control system 302 enabling the passenger to choose which path the ride vehicle 12 ultimately takes. For example, the control system 302 includes a probe 304 that may be mounted to the first bogie 130 and/or the second bogie 132.

In certain embodiments, the probe 304 may be mounted on an actuated wheel 305 configured to move in a first direction 306 and a second direction 308. The movement of the probe 304 may be controlled by the passenger using the steering wheel 28 or some another control input mechanism. As the passenger moves the steering wheel 28 (e.g., to drift) in the first direction 306, the probe 304 may move to a first position 310 (e.g., via the wheel 305). Similarly, as the passenger moves the steering wheel 28 (e.g., to drift) in the second direction 308, the probe may move to a second position 312. It should be noted that in other embodiments, turning the steering wheel in the first direction 306 may direct the probe 304 to move to the second position 312, and moving the steering wheel 28 in the second direction 308 may direct the probe 304 to move to the first position 310. When the track 14 does not involve a junction, movement of the probe 304 may not significantly affect the ride assembly 10 (e.g., the probe 304 may contact a wall of the track 14 but movement or speed of the ride vehicle 12 is not affected). Therefore, although the probe 304 may be moving back and forth as the ride vehicle 12 travels along the track 14, the enjoyment of the passenger is not disturbed.

When the passenger sees the junction 300 approaching, the passenger may adjust the steering wheel 28 to choose a path that the ride vehicle 12 will follow. In the illustrated embodiment of FIG. 11, the passenger may select a first path 314 or a second path 316 by correspondingly moving the probe 304. For example, as the probe 304 moves sufficiently in the first direction 306 at the time of hitting or arriving at or near the junction 300, the probe 304 may be received by the first path 314, thereby directing the ride vehicle 12 to follow the first path 314. Similarly, as the probe 304 moves sufficiently in the second direction 308 at the time of hitting or arriving at or near the junction 300, the probe 304 may be received by the second path 316, thereby directing the ride vehicle 12 to follow the second path 316. It should be noted that while the junction 300 illustrated in FIG. 11 includes two paths 314 and 316, any suitable number of paths may be included in a junction of the track 14.

In certain embodiments, the junction 300 includes a center wall 318. Therefore, when the passenger fails to adjust the steering wheel 28 to move the probe 304 into the first position 310 or the second position 312, the probe 304 may be moved automatically via the vehicle control system to avoid contact between the probe 304 and the center wall 318. In certain embodiments, the vehicle control system may be programmed to direct the probe 304 to move to the first position 310 or the second position 312 when the ride vehicle 12 is a predetermined distance from the junction 300.

In other embodiments, the vehicle control system may be programmed to direct the probe 304 to move to the first position 310 or the second position 312 based on a combination of a speed of the ride vehicle 12 and a distance between the ride vehicle 12 and the junction 300. Such a system may prevent contact between the probe 304 and the center wall 318 so that the passenger experiences a smooth transition into a path of the junction 300.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A ride assembly, comprising:

a passenger vehicle comprising front wheels, rear wheels, a motor, and a steering wheel;

wherein the front and rear wheels are disposed on a surface;

wherein the motor is configured to provide power to the front wheels to propel the passenger vehicle; and wherein the steering wheel is configured to adjust a position of the rear wheels and enable the passenger vehicle to drift;

a track forming a trough in the surface; and a bogie hingedly coupled to the passenger vehicle to enable the passenger vehicle to drift, wherein the bogie is disposed in the trough, and wherein the bogie is configured to direct movement of the passenger vehicle along the track.

2. The ride assembly of claim 1, wherein the surface comprises concrete or asphalt.

3. The ride assembly of claim 1, wherein the trough comprises a drain configured to prevent water accumulation in the trough.

4. The ride assembly of claim 1, wherein the passenger vehicle comprises a receiver, the surface comprises one or more emitters, and the receiver is configured to detect an emitter of the one or more emitters when the passenger vehicle is positioned above the emitter.

5. The ride assembly of claim 4, wherein a passenger control feature is activated when the receiver detects the emitter.

6. The ride assembly of claim 5, wherein the passenger control feature is configured to bounce the passenger vehicle in a vertical direction with respect to the surface when activated.

7. The ride assembly of claim 5, wherein the passenger control feature is configured to accelerate movement of the passenger vehicle when activated.

8. The ride assembly of claim 1, comprising a slot filler coupled to the bogie and disposed in the trough, wherein the slot filler is aligned with a travel path of the rear wheels and is configured to be substantially flush with the surface.

9. The ride assembly of claim 1 wherein the passenger vehicle comprises a stop mechanism configured to block the passenger vehicle from drifting beyond a predetermined distance.

10. The ride assembly of claim 1, wherein the motor is electric and configured to receive power from a brush in contact with an electric power strip disposed in the trough.

11. A ride assembly, comprising:

a passenger vehicle comprising front wheels, rear wheels, an electric motor, and a steering system;

wherein the front and rear wheels are disposed on a surface;

wherein the electric motor is configured to provide power to the front wheels to propel the passenger vehicle and to provide power to the steering system; and wherein the steering system is configured to utilize the power from the electric motor to adjust a position of the passenger vehicle, such that the passenger vehicle may drift, and wherein the steering system is configured to block the passenger vehicle from drifting beyond a predetermined distance;

a track forming a trough in the surface; and a bogie hingedly coupled to the passenger vehicle to enable the passenger vehicle to drift, wherein the bogies is disposed in the trough, and wherein the bogie is configured to direct movement of the passenger vehicle along the track.

12. The ride assembly of claim 11, wherein the steering system comprises an Ackermann steering system.

13. The ride assembly of claim 11, wherein the steering system comprises a gear and a threaded rod coupled to the passenger vehicle, wherein the gear is configured to rotate such that the threaded rod adjusts the position of the passenger vehicle with respect to the track.

14. The ride assembly of claim 11, wherein the bogie comprises one or more up-stop wheels configured to contact the surface, one or more side guide wheels configured to contact a side of the trough, or a combination thereof.

15. The ride assembly of claim 11, wherein the bogie is coupled to one or more guide tracks, and wherein the bogie comprises one or more wheels configured to move along the one or more guide tracks.

16. The ride assembly of claim 11, wherein the passenger vehicle comprises a receiver, the surface comprises one or more emitters, and the receiver is configured to detect an emitter of the one or more emitters when the passenger vehicle is positioned above the emitter.

17. A ride assembly, comprising:

a passenger vehicle comprising front wheels, rear wheels, a steering system, and a receiver;

wherein the front and rear wheels are disposed on a surface;

wherein the steering system is configured to adjust a position of the passenger vehicle enabling the passenger vehicle to drift and to block the passenger vehicle from drifting beyond a predetermined distance; and wherein the receiver is configured to detect an emitter disposed on the surface when the passenger vehicle is positioned above the emitter;

a track forming a trough in the surface; and a bogie hingedly coupled to the passenger vehicle to enable the passenger vehicle to drift, wherein the bogie is disposed in the trough, and wherein the bogie is configured to move the passenger vehicle along the track.

18. The ride assembly of claim 17, wherein the passenger vehicle comprises a controller coupled to the receiver, and wherein the controller is configured to activate a passenger control feature when the receiver detects the emitter.

19. The ride assembly of claim 18, wherein the passenger control feature is configured to bounce the passenger vehicle in a vertical direction with respect to the surface when activated.

20. The ride assembly of claim 18, wherein the passenger control feature is configured to accelerate movement of the passenger vehicle when activated.

* * * * *